US005100351A

United States Patent [19]

Shibata

[11] Patent Number: 5,100,351

[45] Date of Patent: Mar. 31, 1992

[54] EXHAUST GAS CLEANING DEVICE FOR OUTBOARD MOTOR

[75] Inventor: Yasuhiko Shibata, Hamamatsu, Japan

[73] Assignee: Sanshin Kogyo Kabushiki Kaisha, Hamamatsu, Japan

[21] Appl. No.: 541,607

[22] Filed: Jun. 21, 1990

[30] Foreign Application Priority Data

Jun. 21, 1989 [JP] Japan ..... 1-156653

[51] Int. Cl.[5] ..... B63H 21/38

[52] U.S. Cl. ..... 440/89

[58] Field of Search ..... 440/89; 60/302

[56] References Cited

U.S. PATENT DOCUMENTS 3,911,852 10/1975 Miller et al. ..... 440/89
4,604,069 8/1986 Taguchi ..... 440/89
4,735,046 4/1988 Iwai ..... 60/295

FOREIGN PATENT DOCUMENTS 63-97820 4/1988 Japan .

*Primary Examiner*—Sherman D. Basinger

*Assistant Examiner*—Thomas J. Brahan

*Attorney, Agent, or Firm*—Ernest A. Beutler

[57] ABSTRACT

Several embodiments of water cooled outboard motors embodying an exhaust system that includes at least one expansion chamber contained within the drive shaft housing and that is provided with a coolant jacket. A catalyst is positioned in the exhaust system within the expansion chamber for treating the exhaust gases delivered from the engine to the expansion chamber. The coolant from the cooling jacket is delivered back to the body of water in which the watercraft is operating without flowing into the expansion chamber so as to protect the catalyst from water damage. In some embodiments, plural expansion chambers are incorporaed. In these other embodiments, the expansion chambers are arranged so as to preclude the likelihood of water impinging on the catalyst if it enters through an underwater exhaust gas discharge opening and also the arrangement is such that water will not contact the catalyst when the outboard motor is tilted up to an out of the water condition.

10 Claims, 4 Drawing Sheets

EXHAUST GAS CLEANING DEVICE FOR OUTBOARD MOTOR

BACKGROUND OF THE INVENTION

This invention relates to an exhaust gas cleaning device for an outboard motor and more particularly to an improved construction for catalytically treating the exhaust gases of an outboard motor without adversely effecting the life of the catalyst.

The problems of air pollution in connection with internal combustion engines and their exhaust products are well known. These problems exist with all applications of internal combustion engines. Two cycle engines, although they have a wide variety of applications, also present particular problems in connection with exhaust emission control due to the fact that the lubricant used to lubricate the engines is also burned in the combustion chamber and is discharged to the atmosphere along with the exhaust gases. Therefore, if any unburned lubricant remains in the exhaust gases, this can cause problems with exhaust emission. This is particularly true when the engine is utilized in conjunction with an outboard motor wherein the exhaust gases are discharged back to the atmosphere through the body of water in which the watercraft is operating. In addition to air pollution, there can also be the problem of water pollution with this type of application.

It is also known that the use of catalysts in the exhaust system can be effective in reducing unwanted exhaust gas constituents. However, even though a catalyst can be effective in treating exhaust gases, the use of catalysts present certain problems.

Specifically, the reliance on a catalyst to treat the exhaust gases can be a problem unless the catalyst has a long service life. That is, if a catalyst is employed in the exhaust system and the catalyst becomes ineffective, not only will the exhaust gas treatment become rendered ineffective or partially effective, but also the running of the engine can be deteriorated due to restriction in the exhaust gas flow.

With outboard motors, it is the normal practice to add water to the exhaust gases as they are discharged to the atmosphere, both for the purposes of cooling and silencing. In addition, the exhaust gases are normally discharged, as aforenoted, to the atmosphere through the body of water in which the watercraft is operating. It is also the normally the practice to water jacket at least a portion of the exhaust system of the outboard motor for cooling and silencing. The use of water in contact with the exhaust gases can give rise to problems in connection with catalysts. If cold water comes in contact with a catalyst bed, it can damage the bed and can also render it ineffective.

In addition to the water problems discussed in the preceding paragraph, it is normally the practice to discharge the high speed exhaust gases through an underwater discharge. Frequently, this discharge is a rearwardly facing opening formed in the hub of the propeller. When this is done, rapid decelerations or reverse operation tend to cause water to be driven backward into the exhaust system. This water can also contact the catalyst and cause the aforenoted damage.

In addition to the problems described in the preceding two paragraphs, it is also normally the practice to tilt up an outboard motor when it is not in operation. If any water is in the exhaust system, this water can come into contact with the catalyst and damage it.

It is, therefore, a principal object of this invention to provide an improved exhaust system for a water cooled outboard motor having a catalyst treated exhaust.

It is a further object of this invention to provide a catalytic exhaust system for an outboard motor wherein water cooling is employed but wherein the water is precluded from coming into contact with a catalyst.

It is a further object of this invention to provide an improved water cooled exhaust system for an outboard motor wherein the exhaust gases are discharged to the atmosphere through the body of water in which the watercraft is operating and wherein contact of the water with the catalyst is precluded.

SUMMARY OF THE INVENTION

This invention is adapted to be embodied in an exhaust system for a water cooled outboard motor having an internal combustion engine having an exhaust gas discharge for discharging exhaust gases from the engine. A drive shaft housing depends from the engine and journals a drive shaft driven by the engine. An expansion chamber is formed at least in part within the drive shaft housing and means deliver exhaust gases from the engine exhaust gas discharge to the expansion chamber. This last named means includes a catalyst contained within the expansion chamber in contact with the exhaust gases flowing from the exhaust gas discharge. A lower unit is carried by the drive shaft housing and contains propulsion means driven by the drive shaft for propelling an associated watercraft. A cooling jacket at least partially encircles the expansion chamber and receives coolant from the engine cooling system. Means are provided for discharging the coolant from the cooling chamber back to the body of water in which the watercraft is operating without contacting the catalyst.

DETAILED DESCRIPTION OF THE PREFERRED EMBODIMENTS OF THE INVENTION

Figure 1:
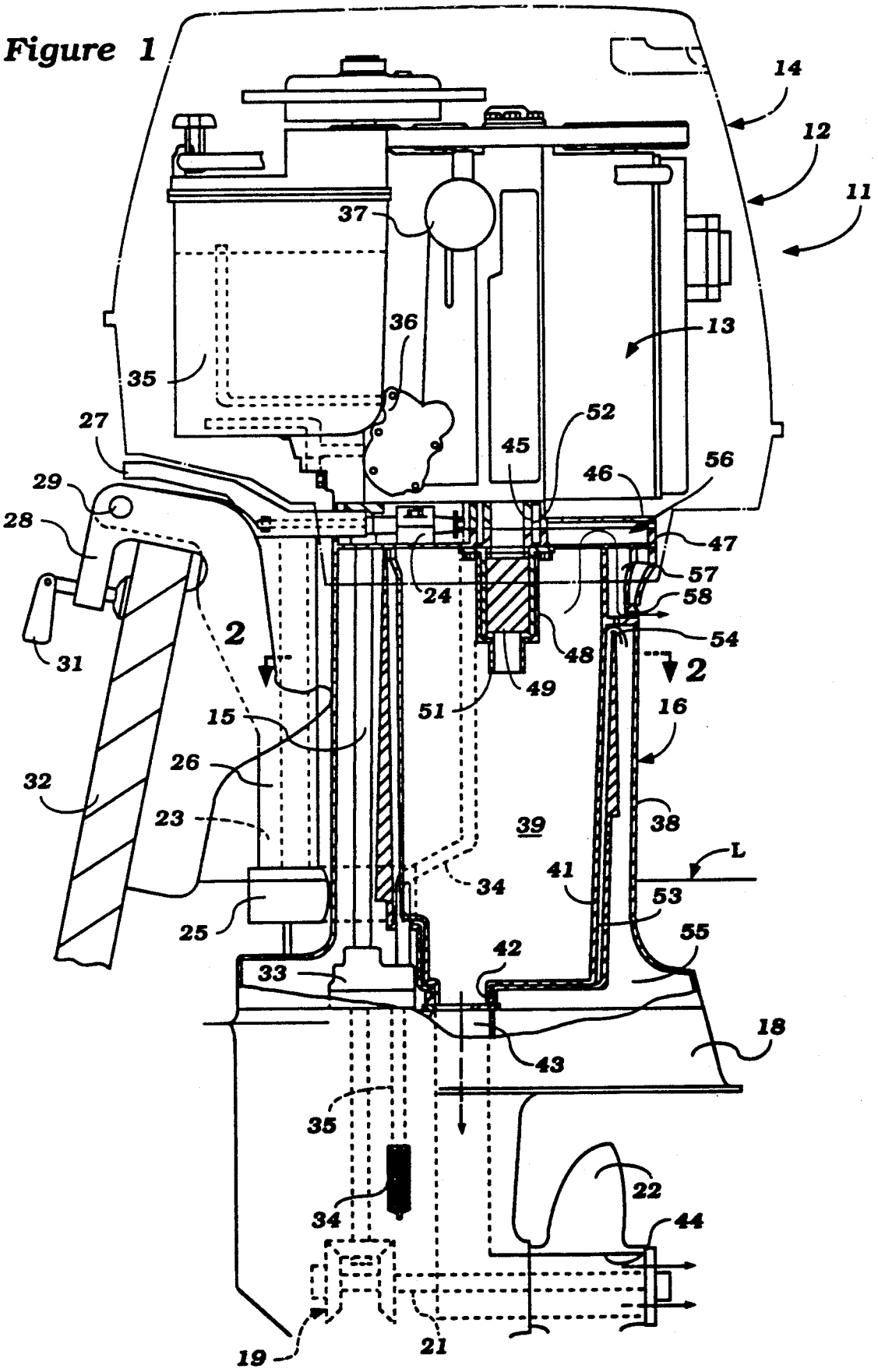
FIG. 1 is a side elevational view of an outboard motor attached to the transom of a watercraft and with portions broken away and shown in section.
Figure 2:
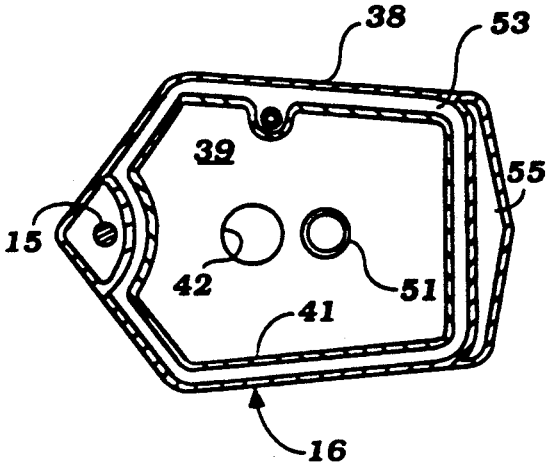
FIG. 2 is a cross sectional view taken along the line 2—2 of FIG. 1.

Referring first to the embodiment of FIGS. 1 and 2, an outboard motor constructed in accordance with this embodiment of the invention is identified generally by the reference numeral 11. The outboard motor 11 includes a power head, indicated generally by the reference numeral 12 and which includes an internal combustion engine 13 which may be of any known type and which operates on a two stroke crankcase compression principle. Although the invention has particular utility in conjunction with such two stroke engines, it should be readily apparent that the invention has utility also in conjunction with four stroke engines. However, the invention has particular utility with two stroke engines due to the fact that the exhaust gases contain burnt lubricant and also, at times, lubricant which may be unburned, as aforenoted. A protective cowling 14, which is shown in phantom, encircles the outboard motor 13 and completes the power head 12.

As is typical with outboard motor practice, the engine 13 is disposed so that its output shaft rotates about a generally vertically extending axis. This output shaft (not shown) is coupled to a drive shaft 15 which rotates about a vertically extending axis and which is contained within a drive shaft housing, indicated generally by the reference numeral 16 and having a construction as will be described.

The drive shaft 15 extends beneath the drive shaft housing 16 into a lower unit 18 wherein there is disposed a conventional bevel gear type forward, neutral, reverse transmission 19 that is adapted to drive a propeller shaft 21 to which a propeller 22 is affixed in a known manner.

A steering shaft 23 is affixed to the drive shaft housing 16 by means of an upper support bracket 24 and a lower support bracket 25. The steering shaft 23 is journaled for steering movement of the outboard motor 11 about a generally vertically extending steering axis within a swivel bracket 26. A tiller 27 is affixed to the upper end of the steering shaft 23 for this steering operation.

The swivel bracket 26 is, in turn, connected to a clamping bracket 28 by means of a tilt pin 29 for tilt and trim movement about a generally horizontally extending axis. The clamping bracket 28 includes a clamping device 31 for affixing the outboard motor 11 to a transom 32 of an associated watercraft which is only shown partially.

Although the engine 13 may be of any known type, it is provided with a liquid cooling system that includes a water pump 33 that is supported between the drive shaft housing 16 and lower unit 18 and which is coupled to the drive shaft 15 for its operation. The water pump 33 draws water through an underwater inlet 34 formed in the lower unit 18 via a conduit 35. This water is then delivered to the cooling jacket of the engine 13 through a delivery conduit 34. The water is then circulated through the engine 13 in a known manner and is discharged back to the body of water in which the watercraft is operating, in a manner to be described.

The engine 13 is lubricated either by lubricant mixed directly with the fuel or, in a preferred embodiment of the engine, by means of a separate external lubricating system that includes a lubricant reservoir 35 that is contained within the power head 12 and enclosed by the protective cowling 14. Lubricant is filled into the tank 35 and then is delivered to the engine 13 in an appropriate manner by means including a lubricant pump 36. The lubricant pump 36 may pump the lubricant through a lubricant filter 37 mounted on the side of the engine 13 for easy servicing.

The construction of the outboard motor 11 as thus far described may be considered to be conventional. For that reason, the portions of the components as thus far described and their specific operation has not been detailed since those skilled in the art will readily understand how to practice this invention from the following description.

The drive shaft housing 16 is comprised of a main outer housing member 38 which may be formed as a casting of a lightweight alloy such as an aluminum alloy and which is generally hollow. An expansion chamber 39 is formed within this hollow outer member 38 by means of an inner shell 41. The lower end of the expansion chamber 39 is provided with a discharge opening 42 which, in turn, communicates with an exhaust gas discharge passage 43 formed in the lower unit 18. This passage 43 extends down into the lower unit and communicates with a through the hub propeller exhaust gas discharge 44 which forms the high speed exhaust gas discharge for the system.

The engine 13 has an exhaust system which includes an exhaust manifold (not shown) that terminates in an exhaust discharge port 45 formed in a spacer plate assembly comprised of an upper member 46 and a lower member 47 which mount the engine 13 on the drive shaft housing 16. An exhaust pipe 48 is affixed in confronting relationship to the exhaust port 45 and contains a catalyst 49 of a suitable material so as to treat the exhaust gases and particularly to remove lubricant which has not been consumed in the combustion process and also so as to otherwise treat the exhaust gases. The flow across the catalyst 49 may be of any desired pattern. The exhaust gases are then discharged into the expansion chamber 39 through a discharge opening 51. The exhaust gases will expand in the chamber 39 and be silenced and then be discharged through the port 42, passage 43 and through the hub exhaust 44.

In order to provide cooling for the exhaust gases, the spacer plate comprised of the members 46 and 47 is provided with a cooling jacket 52 to which coolant is delivered from the engine cooling system in a known manner. In addition, a further water jacket 53 is formed by a wall of the drive shaft housing member 38 and the expansion chamber member 41 so as to receive this coolant and encircle the expansion chamber 49 for its coolant. This coolant then overflows through a weir passageway 54 into a chamber 55 formed to the rear of the water jacket and is discharged to the body of water in which the watercraft is operating in a suitable manner.

It should be noted, therefore, that the coolant from the jacket 53 and jacket 52 is separated from the interior of the expansion chamber 39 and hence cannot come into contact with the catalyst. As a result, damage and degradation of the catalyst 49 will be prevented.

The seal at the lower end of the water jacket 53 around the exhaust passage 43 is not completely watertight. Hence, some of the cooling water may drain into the passage 43. This cooling water is useful in cooling the elastic damper of the propeller 22. However, this water cannot flow back and impinge upon the catalyst 49 because of the presence of the expansion chamber 39. The expansion chamber 39 will prevent any negative pressure in the exhaust system from acting on this water to draw it up into contact with the catalyst 49.

As is well known, when the outboard motor 11 is propelling the associated watercraft at a low speed, the water level will reach the level L and the through the hub exhaust 44 will be deeply submerged. The water pressure is much higher than the exhaust gas pressures.

Hence there is provided an above the water low speed exhaust discharge, indicated generally by the reference numeral 56 which cooperates with the main expansion chamber 39 through a restricted passageway. A further expansion chamber 57 is then provided in the upper portion of the drive shaft housing 46 and the exhaust gases may exit after being silenced through an above the water restricted exhaust gas discharge 58.

Figure 3:
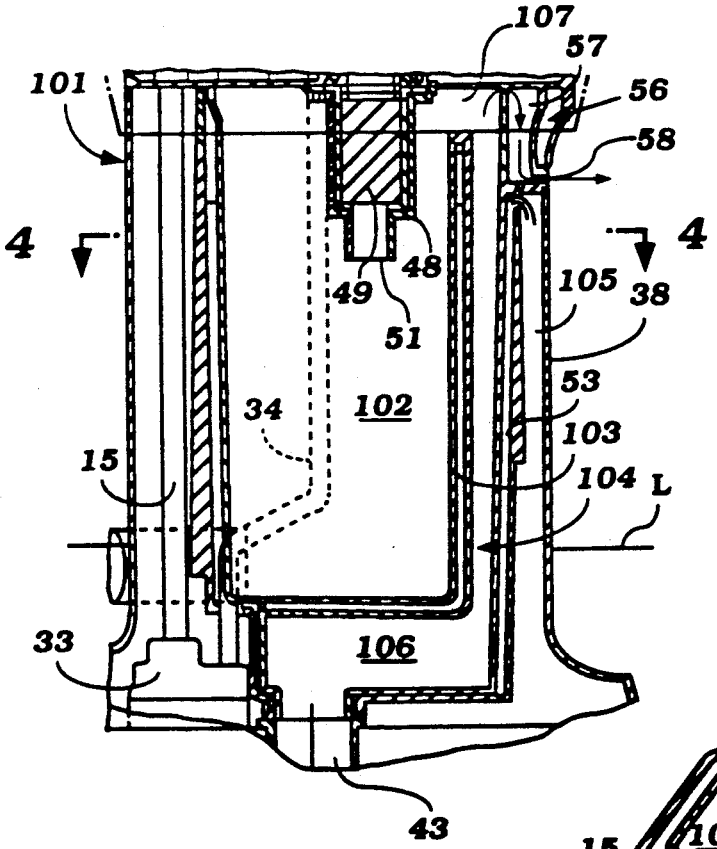
FIG. 3 is a partial cross sectional view, in part similar to FIG. 1, and shows another embodiment of the invention.
Figure 4:
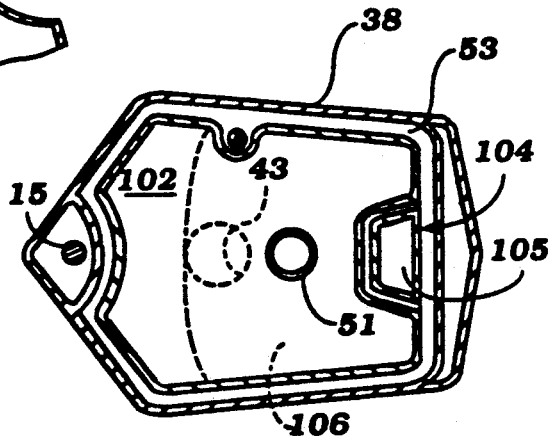
FIG. 4 is a cross sectional view taken along the line 4—4 of FIG. 3.

In the embodiment of the invention as thus far described, there has been provided a single expansion chamber 39 for high speed exhaust gas discharge silencing. In some instances, it may be desirable to provide a still further expansion chamber. The use of a further expansion chamber will not only further assist in silencing the exhaust gases, but the expansion chambers can be configured in such a way that further insurance against water contact of the catalyst can be provided. The embodiment of FIGS. 3 and 4 show such an arrangement. In this embodiment, components which are the same as those previously described have been identified by the same reference numerals and will not be described again, except insofar as is necessary to understand the construction and operation of this embodiment.

In this embodiment, the drive shaft housing is indicated generally by the reference numeral 101 and, like the previously described embodiment, is comprised of a main outer member 38. In this embodiment, however, a first expansion chamber 102 is provided by an inner member 103. A further member, indicated generally by the reference numeral 104 forms a passageway 105 that extends along the rear edge of the expansion chamber 102 and which defines a lower closure for this expansion chamber so as to define a second expansion chamber 106 that is positioned beneath the expansion chamber 102. The passageway 105 interconnects the expansion chamber 106 with the expansion chamber 102 through a cross over passageway 107 that extends across the upper end of the expansion chamber 102 and which also provides the source of communication with the low speed exhaust gas discharge 56. The water jacket 53 then encircles the outer portion of the assembly and provides the cooling as aforedescribed. However, and as in the previously described embodiment, water is prevented from contacting the catalyst 49. In this embodiment, even further isolation is provided between the expansion chamber 102 and the water discharge from the cooling jacket 53.

Because the lower wall of the member 104 extends in confronting relationship to the exhaust gas passage 43, any water tending to flow back through the exhaust passage 43 due to sudden deceleration or reverse operation will impact on this wall and be precluded from contacting the catalyst 49. Also, since the passageway 105 is rearwardly disposed, when the outboard motor is tilted up out of the water, any water which may be in the passageways will not contact the catalyst 49. Furthermore, the central location of the catalyst 49 in the expansion chamber 39 in the embodiment of FIGS. 1 and 2 and the expansion chamber 102 of this embodiment will also insure against such water contact when the outboard motor is tilted up.

Figure 5:
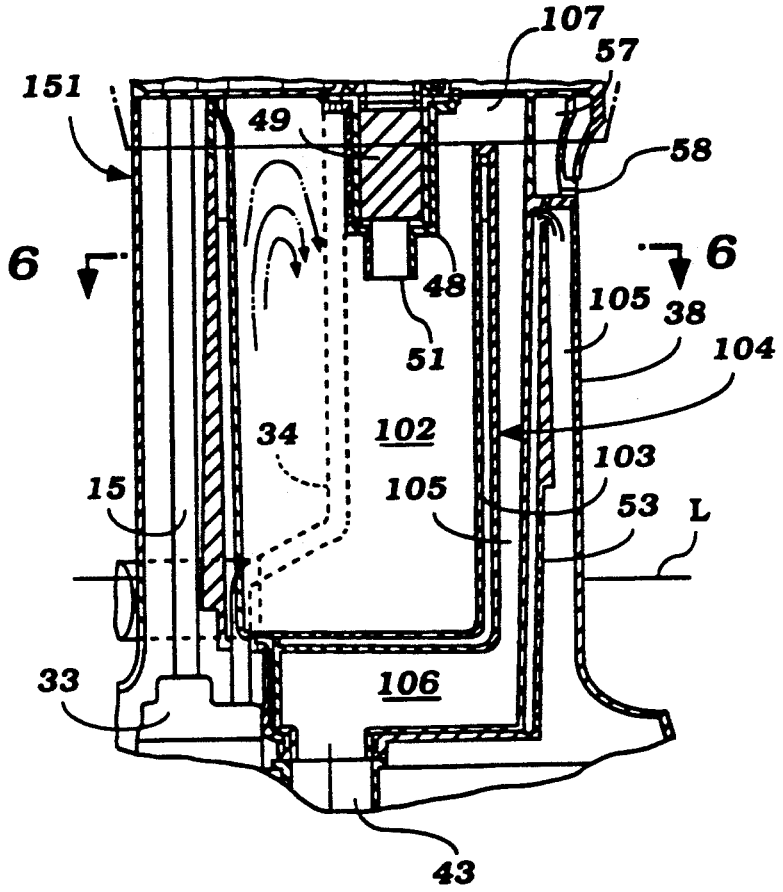
FIG. 5 is a partial cross sectional view, in part similar to FIGS. 1 and 3, and shows another embodiment of the invention.
Figure 6:
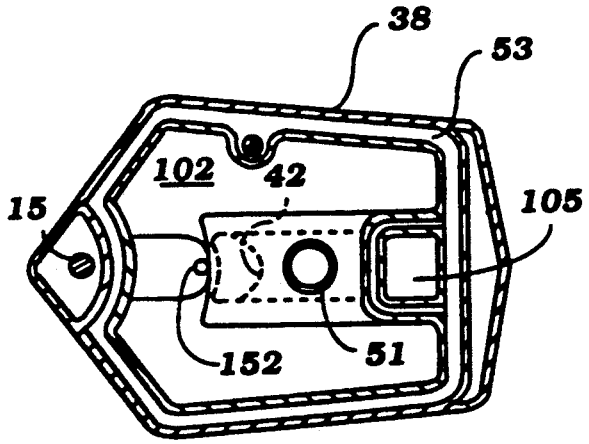
FIG. 6 is a cross sectional view taken along the line 6—6 of FIG. 5.

FIGS. 5 and 6 show another embodiment of the invention which is generally similar to the embodiment of FIGS. 3 and 4 and, for that reason, components of this embodiment which are the same as the previously described embodiment have been identified by the same reference numeral. In this embodiment, the drive shaft housing 151 again defines a first expansion chamber 102 and a second expansion chamber 106 as previously described. In this embodiment, however, a small passageway 152 permits any water in the expansion chamber to be discharged directly from the expansion chamber 102 to the discharge opening 43. The hole 152, is, however, so small that water tending to back up in the exhaust passageway 49 cannot enter the expansion chamber 102 and will also permit draining of any water when the outboard motor is tilted up. As noted above, in all other regards this embodiment is the same as that previously described.

Figure 7:
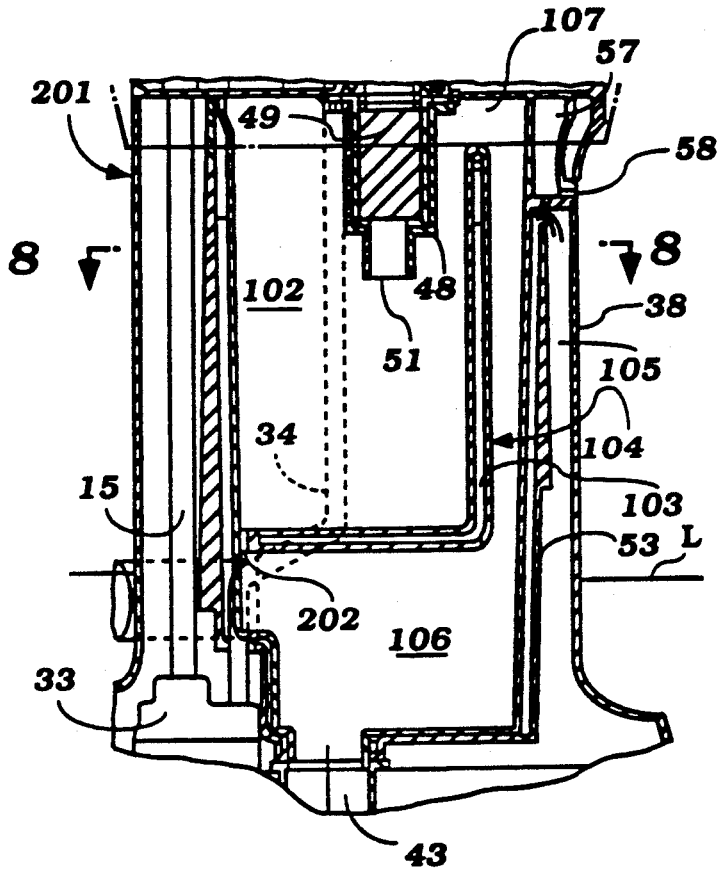
FIG. 7 is a further partial cross sectional view, in part similar to FIGS. 1, 3 and 5, and shows yet another embodiment of the invention.
Figure 8:
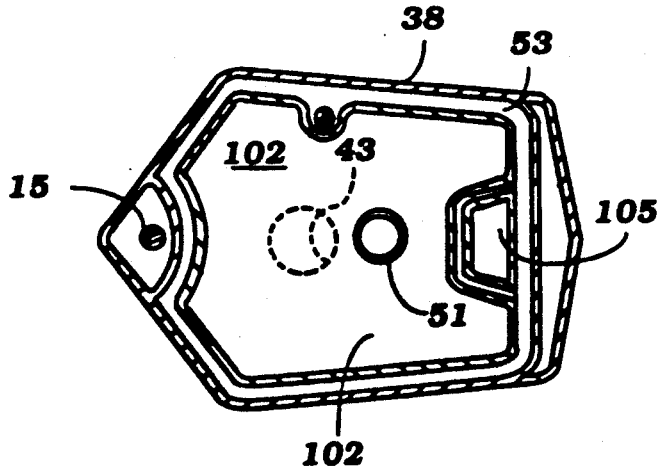
FIG. 8 is a cross sectional view taken along the line 8—8 of FIG. 7.

FIGS. 7 and 8 show another embodiment of the invention which is generally similar to the embodiment of FIGS. 5 and 6. In this embodiment, however, the drive shaft housing 201 contains a first expansion chamber 102 which is generally smaller than the first expansion chamber of the embodiment of FIGS. 3 and 4, while the second expansion chamber 106 is substantially larger. In all other regards, this embodiment is the same as that of FIGS. 3 and 4. For that reason, the same reference numerals have been used to identify the same components, even though they may have different configurations and volumes.

In this embodiment, there is further provided a small passageway 202 that interconnects the expansion chamber 102 with the expansion chamber 106, bypassing the passageway 105 and permitting water drainage without reverse flow.

It should be readily apparent from the foregoing description that a number of embodiments of the invention have been illustrated and described, each of which provides a very effective catalyst treatment for the exhaust gases of a water cooled outboard motor and which precludes degradation or damage to the catalyst through water contact. Although a number of embodiments of the invention have been illustrated and described, various changes and modifications may be made without departing from the spirit and scope of the invention, as defined by the appended claims.

I claim:

1. An exhaust system for a water cooled outboard motor having an internal combustion engine having an exhaust gas discharge for discharging exhaust gases from said engine, a drive shaft housing depending from said engine and journaling a drive shaft driven by said engine, and expansion chamber formed at least in part with said drive shaft housing, said expansion chamber having an open top defined by upstanding side walls and a lower wall and having the major portion of its volume contained within said drive shaft housing, means for delivering exhaust gases from said engine exhaust gas discharge to said expansion chamber including a catalyst contained in substantial part within said drive shaft housing and in contact with the exhaust gases flowing from said exhaust gas discharge, a lower unit carried by said drive shaft housing and containing propulsion means driven by said drive shaft for propelling an associated watercraft, a cooling jacket formed in said drive shaft housing and encircling at least in part said expansion chamber side walls and having an open top, means for delivering coolant from said engine to said cooling jacket, and means for discharging coolant from said cooling jacket back to the body of water in which said watercraft is operating without contacting said catalyst.

2. An exhaust system as set forth in claim 1 wherein the catalyst is positioned substantially inwardly from the side walls of the expansion chamber so as to be unaffected by water which may accumulate in the expansion chamber when the outboard motor is tilted up.

3. An exhaust system as set forth in claim 1 wherein there is provided a second expansion chamber in the draft shaft housing and exhaust gases flow at least in part from one of the expansion chambers to the other of the expansion chambers and at least one of the expansion chambers is provided with a cooling jacket.

4. An exhaust system as set forth in claim 3 wherein the exhaust gases are discharged from one of the expansion chambers to the body of water in which the watercraft is operating through an underwater exhaust gas discharge opening and wherein the catalyst is positioned within the other expansion chamber and the one expansion chamber provides a baffle to preclude water from flowing into the other expansion chamber from the underwater exhaust gas outlet.

5. An exhaust system as set forth in claim 4 wherein the other expansion chamber has a drain passage to permit water to drain from the other expansion chamber to the one expansion chamber without permitting water to flow in the opposite direction.

6. An exhaust system for a water cooled outboard motor having an internal combustion engine having an exhaust gas discharge for discharging exhaust gases from said engine, a drive shaft housing depending from said engine and journaling a drive shaft driven by said engine, and expansion chamber formed at least in part with said drive shaft housing and having the major portion of its volume contained within said drive shaft housing means for delivering exhaust gases from said engine exhaust gas discharge to said expansion chamber including a catalyst contained in substantial part within said drive shaft housing and in contact with the exhaust gases flowing from said exhaust gas discharge, a lower unit carried by said drive shaft housing and containing propulsion means driven by said drive shaft for propelling an associated watercraft, a cooling jacket formed in said drive shaft housing and encircling at least in part said expansion chamber, means for delivering coolant from said engine to said cooling jacket, and means for discharging coolant from said cooling jacket back to the body of water in which said watercraft is operating without contacting said catalyst, said expansion chamber discharging exhaust gases to the body of water in which the watercraft is operating through an underwater exhaust gas outlet, and means extending across the communication of the expansion chamber with said underwater exhaust gas outlet for precluding water from contacting said catalyst int he event water tends to flow upwardly through said exhaust gas outlet.

7. An exhaust system for a water cooled outboard motor having an internal combustion engine having an exhaust gas discharge for discharging exhaust gases from said engine, a drive shaft housing depending from said engine and journaling a drive shaft driven by said engine, an expansion chamber formed at least in part with said drive shaft housing, means for delivering exhaust gases from said engine exhaust gas discharge to said expansion chamber including a catalyst contained within said expansion chamber and in contact with the exhaust gases flowing from said exhaust gas discharge, a lower unit carried by said drive shaft housing and containing propulsion means driven by said drive shaft for propelling an associated watercraft, a cooling jacket encircling at least in part said expansion chamber, means for delivering coolant from said engine to said cooling jacket, means for discharging coolant from said cooling jacket back to the body of water in which said watercraft is operating without contacting said catalyst, said expansion chamber discharging exhaust gases to the body of water in which the watercraft is operating through an underwater exhaust gas outlet, and means extending across the communication of the expansion chamber and the underwater exhaust gas outlet for precluding water from contacting the catalyst in the event water tends to flow upwardly through the exhaust gas outlet.

8. An exhaust system for a water cooled outboard motor having an internal combustion engine having an exhaust gas discharge for discharging exhaust gases from said engine, a drive shaft housing depending from said engine and journaling a drive shaft driven by said engine, a first expansion chamber formed at least in pat with said drive shaft housing, means for delivering exhaust gases from said engine exhaust gas discharge to said first expansion chamber including a catalyst contained within said first expansion chamber and in contact with the exhaust gases flowing from said exhaust gas discharge, a lower unit carried by said drive shaft housing and containing propulsion means driven by said drive shaft for propelling an associated watercraft, a cooling jacket encircling at least in part said first expansion chamber, means for delivering coolant from said engine to said cooling jacket, means for discharging coolant from said cooling jacket back to the body of water in which said watercraft is operating without contacting said catalyst, a second expansion chamber in said rive shaft housing, and means for providing for flow of exhaust gases at least in part from said first expansion chamber to said second expansion chamber.

9. An exhaust system as set forth in claim 8 wherein the exhaust gases are discharged from the second expansion chamber to the body of water in which the watercraft is operating through an underwater exhaust gas discharge opening and the second expansion chamber provides a baffle to preclude water from flowing into the first expansion chamber from the underwater exhaust gas outlet.

10. An exhaust system as set forth in claim 9 wherein the one expansion chamber has a drain passage to permit water to drain from the first expansion chamber to the second expansion chamber without permitting water to flow in the opposite direction.

* * * * *